United States Patent [19]

Lesourd

[11] Patent Number: 4,759,994

[45] Date of Patent: Jul. 26, 1988

[54] SANDWICH-TYPE STAMPABLE, METALLIC STRUCTURE

[76] Inventor: Hugues Lesourd, 3, rue de Magdebourg, Paris, France, 75116

[21] Appl. No.: 890,894

[22] Filed: Jul. 28, 1986

Related U.S. Application Data

[63] Continuation of Ser. No. 675,438, Nov. 27, 1984, abandoned.

[30] Foreign Application Priority Data

Dec. 12, 1983 [FR] France ..... 83 19855
Dec. 20, 1983 [FR] France ..... 83 20341

[51] Int. Cl.[4] ..... B32B 1/08; B32B 5/02

[52] U.S. Cl. ..... 428/594; 428/608; 428/626; 138/143; 138/148

[58] Field of Search ..... 428/608, 261, 625, 626, 428/624, 594; 52/794, 630; 138/153, 142, 143, 148

[56] References Cited

U.S. PATENT DOCUMENTS

| | | | |
|---|---|---|---|
| 1,280,909 | 10/1918 | Wales et al. | 428/614 |
| 1,840,305 | 1/1932 | Andrus et al. | 138/143 |
| 2,423,870 | 7/1947 | Blessing | 138/148 |
| 2,694,852 | 11/1954 | Rogers | 428/608 |
| 3,086,625 | 4/1963 | Wyatt | 138/142 |
| 3,144,370 | 8/1964 | Bennett et al. | 228/903 |
| 3,764,277 | 10/1973 | Hollis | 428/593 |
| 4,297,154 | 10/1981 | Keller | 428/625 |
| 4,414,257 | 11/1983 | Haraga et al. | 428/594 |

FOREIGN PATENT DOCUMENTS

| | | | |
|---|---|---|---|
| 2481644 | 11/1981 | France . | |
| 55242 | 4/1983 | Japan | 428/608 |
| 1128633 | 9/1968 | United Kingdom . | |

*Primary Examiner*—John J. Zimmerman
*Attorney, Agent, or Firm*—Sandler & Greenblum

[57] ABSTRACT

A sandwich-type structure comprises two external metal plates and an inner core held between the two external plates and constituted by a metallic screen netting or grid. In order to be easily stamped said structure comprises, between the plates, a layer of adhesive making the bond between the plates and the core. This adhesive is located only inside the meshes of the core, whereas the contact zones between the core and the plates are left free of adhesive. In the case where all three elements are in weldable metal, spot welding remains possible, if necessary, on the periphery or through the mass, these weld points being in this latter case sufficiently far apart to allow a geometrical deformation of the meshes of the metallic netting or grid constituting the core.

9 Claims, 2 Drawing Sheets

SANDWICH-TYPE STAMPABLE, METALLIC STRUCTURE

This application is a continuation of application Ser. No. 675,438, filed Nov. 27, 1984, now abandoned.

BACKGROUND OF THE INVENTION

The present invention relates to a sandwich-type, stampable, metallic structure, to its manufacturing process and to an installation for carrying out said process.

Sandwich-type metallic structures are already known which have the property of being very rigid whilst of low density. Such structures generally result from the assembly of two plate elements, which are relatively thin and flat with a core piece which is thicker, interposed between the two plate elements.

U.S. Pat. No. 3,764,277 describes such a sandwich-type metallic structure, in which the core element, which is constituted of a metallic grid or netting, is sandwiched between two relatively thin sheets of plates, and welded thereto. Although such a sandwich structure has the advantage of being very rigid as well as having a low density, there is nevertheless a disadvantage which is that they are not usable for stamping operation due to the rigid bond produced between the core element and the sheets constituting the two plates as a result of the large number of welding points used to achieve bonding. Said sandwich structure, in consequence, is unsuitable in all cases where the object is to produce pieces of very different shapes by stamping, as for example, in the motorcar industry.

The same applies to the structure described in British Pat. No. 1,128,633 which is a "honeycombed"-type structure in which the walls of the cells are constituted by sandwich-type metallic structures, the core element of which is a metallic netting. Although the wall has had to be deformed in order to form the honeycomb, the result is a particularly rigid piece which cannot be stamped without the geometric structure being deformed.

SUMMARY OF THE INVENTION

The object of the present invention is to overcome the aforesaid disadvantages by proposing a sandwich structure of particularly simple design and well suited for stamping operations. assembling is produced, according to the invention, with an adhesive, the final structure which is obtained has the advantage of having a good flexional rigidity which is due to the metallic grid or netting constituting the core, and which also offers a stamping possibility due to the elongation properties of the metal, the warp shrinkage of the wires and to the geometrical deformability of the meshes.

Once stamped or rolled, the different elements constituting the sandwich structure remain assembled together even without a bond other than the peripheral bond.

Said weld points are, in the later case, sufficiently apart to allow geometrical deformability of the meshes of the metallic netting grid which constitutes the core.

It is possible, in order to constitute the core of the sandwich structure, to use metallic fabrics obtained by sequenced interweaving of metallic wires forming between them definite gaps. Such materials are characterized by the nature of the warps and the wefts as well as by their "weave" which reflects the warps and wefts interlacing pattern. Advantageously, two types of weave can be used in the sandwich structures according to the invention. One such usable weave is the plain or basket weave with square meshing, the other being the twilled weave with herring-bone woven square meshing to obtain a greater stability when unrolling during the manufacture. The fabrics used in the manufacture of sandwich structures according to the invention can have the same wires for the warps and the wefts. They are in annealed soft steel which is easiest to work, and the most deformable, besides being inexpensive. The diameter of the wired used being between 0.22 and 0.45 mm, the apparent yield point of said wires is between 26 and 32 daN/mm$^2$, the maximum strength of the wire is 45 daN/mm$^2$, and the mesh aperture size is between 1 and 3 mm.

According to a variant, it is also possible to use an expanded metal for the core.

The structure according to the invention can be used for producing tubular pieces. In this case, the sandwich structure is rolled over, after what, its opposed edges are welded together, by the electric or supersonic welding methods.

Advantageously, to produce a tubular piece, it is possible to use a sandwich structure constituted by a complex which is dissymmetrical, thickness-wise, meaning that it is composed of a thick plate on the outside and of a thinner plate on the inside. The welding which is designed to hold the tubular piece in its tubular shape is then conducted on the outer thicker plate, whereas the inner thinner plate is applied against the metallic screen netting or grid constituting the core, under the effect of its elastic return.

It is also possible to use other metals for producing the outer and inner plates of the tube, depending on the required applications.

BRIEF DESCRIPTION OF THE DRAWINGS

The invention will be more readily understood on reading the following description with reference to the accompanying drawings, in which.

DESCRIPTION OF THE PREFERRRED EMBODIMENTS

The sandwich-type metallic structure according to the invention is produced by assembling two external elements or plates 1 and 2 between which is confined an internal element or core 3.

The plates 1 and 2 are constituted by thin metal strips or sheets whereas the core 3 is constituted by metallic screen netting or similar material.

According to the invention, one, two or all three elements are coated with adhesive before the sandwich structure is assembled. In the illustrated example, only one plate, the lower one, is coated on its upper face designed to come into contact with the core 3. A layer of adhesive 4 in fluid state is thus formed on the lower plate 2, which layer is optionally continuous or discontinuous or in the form of lines or punctual zones. Before being assembled together, the two plates 1 and 2 are such as illustrated in part A of FIG. 1.

Figure 1:
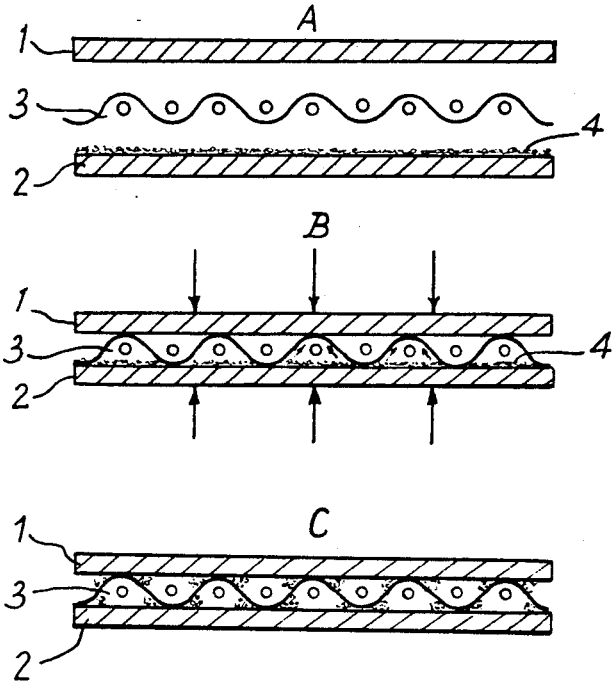
FIG. 1 is a diagrammatical cross-section illustrating the different phases of production of a sandwich structure according to the invention.

Once plate 2 has been coated with adhesive, the two plates 1 and 2 are pressed one over the other, as illustrated in part B of FIG. 1. This pressing operation must be carried out before the adhesive 4 sets e.g. while the adhesive is still in fluid state. As a result of said pressing operation, the adhesive 4, still in fluid state, can run through the solid parts of the core 3 and it can settle in the meshes of the netting constituting the core 3, as indicated with arrows in part B of FIG. 1.

After setting of the adhesive, a sandwich structure is obtained such as that illustrated in part C of FIG. 1. Said sandwich structure comprises the two plates 1 and 2 bonded together by the hard-set adhesive 4, which fills the gaps inside the middle core 3. It will be noted that the wires of the metallic netting constituting the core 3 remain in contact with the plate 1, 2 in areas which are virtually free of adhesive, so that it is thereafter possible to complete the assembly by a welding operation due to the fact that the electric current can readily flow through from one plate to the other whenever said plates are in a conducting material.

Figure 2:
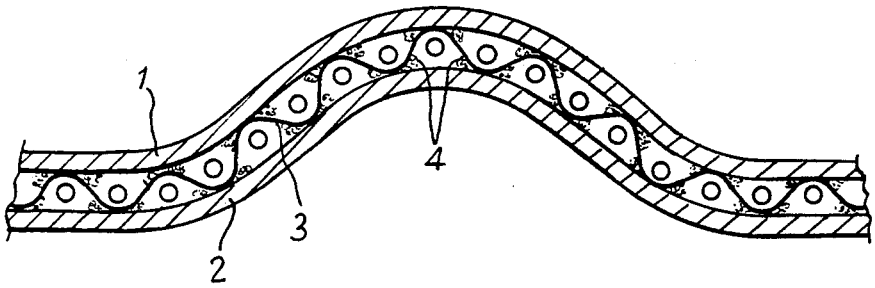
FIG. 2 is a diagrammatical cross-section of a sandwich structure according to the invention after a stamping operation.

Once the assembling of the sandwich structure is completed, it is possible to carry out a stamping operation therewith in order to give it any shape wanted. FIG. 2 illustrates by way of example, a stamped piece which can be obtained with a flat sandwich structure. Deformation of said sandwich structure is made possible due to the fact that the adhesive making the bond between the two plates 1 and 2 shows, in the hard-set state, a certain elasticity allowing a relative sliding between the two plates 1, 2 and the intermediate core 3.

According to a variant embodiment and for special applications, the core may be constituted by a plurality of superimposed grids or metallic nettings.

Figure 3:
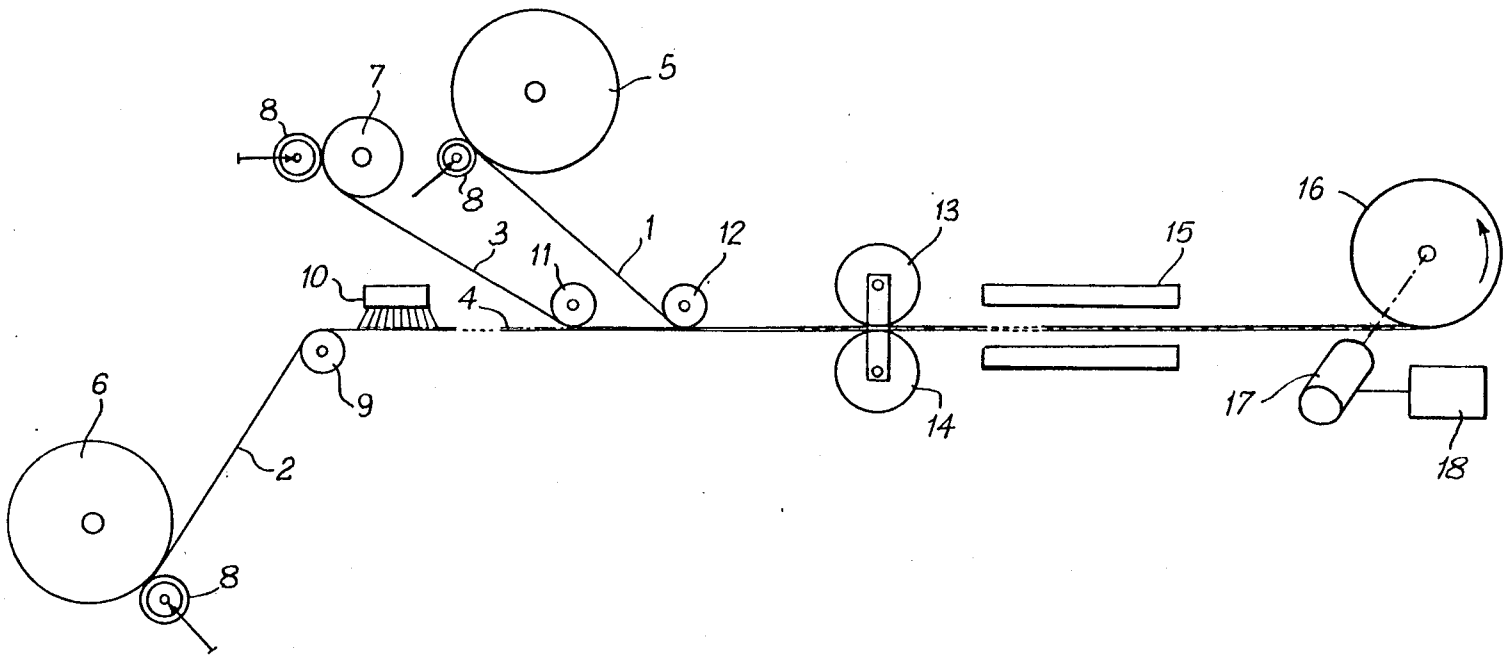
FIG. 3 is a diagram of an installation for the production of a sandwich structure according to the invention.

Referring now to FIG. 3, this shows an installation for carrying out the process according to the invention. The described installation only applies the adhesive on the lower plate, but depending on the case, it is also possible to apply the adhesive on the metallic netting with subsequent raking operation and/or on the upper plate.

The metal sheet 1 constituting the upper plate, the metal sheet 2 constituting the lower plate and the core 3 in metallic netting are delivered in contnuous manner from respective drum winders 5, 6 and 7. All three winders are equipped with tension-regulating brakes 8.

The metal sheet constituting the lower plate 2 rolls over a return pulley 9 in order to be horizontally deviated and then to pass under an adhesive applying device 10 which projects a layer of adhesive 4 on the upper face of the plate 2. The adhesive-coated lower plate 2 then passes under a guiding roller 11 and the grid constituting the core 3 passes between the lower plate 2 and said guiding roller 11. The assembly constituted by the metallic netting 3 and the adhesive-coating lower plate 2 then passes under another guiding roller 12 towards which is horizontally deviated the upper plate 1 which plate is thus brought and applied over the metallic netting constituting the core 3. The assembly constituted by the upper plate 1, the lower plate 2 and the intermediate metallic netting core 3 immediately follows through a pair of superposed pressing rollers 13, 14. Said pressing rollers are covered, on their periphery, with a layer of very hard rubber in order to correct, as far as possible, any flatness defects. At the outlet from the pressing assembly 13, 14 there can be provided heating means 15 permitting to speed up the setting of the adhesive whenever necessary. The resulting sandwich structure is then driven and spooled to form a winding 16 on a winding spindle driven in rotation by a motor 17 controlled by a servo-control device 18. As a result, a permanent pressure is exerted on every turn of the winding 16 due to the winding tension ensured by the servo-control system 17, 18. Said pressure which is around a few bars, accentuates the adhesive flow between the solid parts, towards the meshes of the metallic netting constituting the core. Said pressure being maintained throughout the complete setting of the adhesive this stops the formation of an insulating film which could prevent any subsequent electric welding operation.

The adhesive used is of the "structural" type. A two-component polyurethane adhesive is better suited for industrial production due to its suppleness when set, which permits stamping and to the possibility that it offers of giving an assembly which can be manipulated a very short while after its application.

The installation 10 for applying the adhesive comprises a measuring/mixing apparatus followed by a depositing or applying apparatus which may be, depending on the case, a spraying apparatus or a small extruding apparatus for stroke deposition.

The quantity of adhesive used is about 100 g/m$^2$, pressure after adhesive application being greater than or equal to 1 bar.

When the adhesive has set completely, it may be necessary to pass the resulting sandwich structure through a planning machine in order to rectify flatness defects due either to the original sheets of metal, or to irregularities in the application of the adhesive.

What I claim is:

1. A sandwich-type metallic structure which is capable of being easily stamped into a variety of shapes, said structure comprising two external metal plates, a first outer external plate and a second, inner external plate, and an inner core positioned between said first and second external plates, said inner core comprising a metallic screen netting or grid, said structure further comprising a layer of adhesive material positioned between said two external metal plates and said core to bond said plates to said core, said inner core comprising a meshing and said adhesive material being located only within the interstices of said meshing, said external plates and said inner core being in contact with each other only at a plurality of contact zones, all of said plate-to-core contact zones being free of said adhesive, such that direct metal-to-metal-to-metal contact exists between said first and second external metal plates and said inner core, wherein said structure comprises means for permitting welding of said structure by conducting electric current from one of said external metal plates to the other of said external metal plates, wherein said plates and said core which are located at at least one of said plurality of contact zones are welded together.

2. A sandwich-type metallic structure in accordance with claim 1 wherein said first external plate is thicker than said second external plate.

3. A sandwich-type structure in accordance with claim 1 wherein said metallic screen netting or grid comprises a planar or basket weave screen having square meshing.

4. A sandwich-type structure in accordance with claim 1 wherein said metallic screen netting or grid comprises a twilled weave screen having a herring bone woven square meshing pattern.

5. A sandwich-type structure in accordance with claim 1 wherein said metallic screen netting or grid comprises an annealed soft steel which is deformable.

6. A sandwich-type structure in accordance with claim 1 wherein said metallic screen netting or grid comprises wire having a diameter between approximately 0.22 and 0.45 mm, a yield point of approximately 26–32 daN/mm$^2$, a maximum strength of approximately 45 daN/mm$^2$, and a mesh aperture size of between 1 and 3 mm.

7. A sandwich-type structure in accordance with claim 1 wherein said adhesive material sets upon hardening, said adhesive material being elastic after setting.

8. A metallic structure in accordance with claim 1, wherein said plates and said core which are located at each of said plurality of contact zones are welded together.

9. A tubular member formed from a sandwich-type metallic structure, said metallic structure comprising an outer metal sheet and an inner metal sheet and an interior core positioned between said two metal sheets, said interior core comprising a metallic wire mesh, said metallic structure further comprising a layer of adhesive bonding said sheets to said core, said adhesive being located only within the interstices of the mesh, thereby forming a plurality of contact zones between said mesh and said sheets which are completely free from adhesive, said sandwich structure being assymetrical in thickness, said exterior metal sheet being thicker than said outer metal sheet being thicker than said inner metal sheet, wherein said outer, relatively thicker metal sheet is welded to itself to form said tube, wherein said inner and outer metal sheets and said interior core contact each other only at a plurality of contact zones, wherein said plates and said core located at at least one of said contact zones are welded together.

* * * * *